US006951347B2

(12) United States Patent
Buquet et al.

(10) Patent No.: US 6,951,347 B2
(45) Date of Patent: Oct. 4, 2005

(54) FRONT BINDING FOR GLIDING-SPORTS DEVICE

(75) Inventors: Thierry Buquet, Coulanges-les-Nevers (FR); Sébastien Rideau, Coulanges-les-Nevers (FR); Frédéric Farges, Nevers (FR)

(73) Assignee: Look Fixations S.A., Nevers (FR)

( * ) Notice: Subject to any disclaimer, the term of this patent is extended or adjusted under 35 U.S.C. 154(b) by 9 days.

(21) Appl. No.: 10/640,571

(22) Filed: Aug. 13, 2003

(65) Prior Publication Data

US 2004/0070177 A1 Apr. 15, 2004

(30) Foreign Application Priority Data

Aug. 22, 2002 (FR) ..... 02 10484

(51) Int. Cl.[7] ..... A63C 9/085

(52) U.S. Cl. ..... 280/625; 280/635; 280/613; 280/628

(58) Field of Search ..... 280/625, 624, 280/635, 611, 613, 623, 626, 628, 630, 634

(56) References Cited

U.S. PATENT DOCUMENTS

| | | | | | |
|---|---|---|---|---|---|
| 3,271,040 | A | * | 9/1966 | Spademan | 280/624 |
| 3,494,628 | A | * | 2/1970 | Spademan | 280/624 |
| 3,666,280 | A | * | 5/1972 | Smolka et al. | 280/630 |
| 4,017,098 | A | * | 4/1977 | Kirsch | 280/625 |
| 4,166,635 | A | | 9/1979 | Salomon | |
| 4,360,218 | A | * | 11/1982 | Spademan | 280/624 |
| 4,395,055 | A | * | 7/1983 | Spademan | 280/624 |
| 4,913,456 | A | * | 4/1990 | Hornschemeyer et al. | 280/630 |
| 4,930,802 | A | * | 6/1990 | Sedlmair | 280/625 |
| 5,040,820 | A | * | 8/1991 | Rigal et al. | 280/625 |
| 6,375,212 | B1 | * | 4/2002 | Hillairet et al. | 280/617 |
| 6,523,852 | B2 | * | 2/2003 | Gignoux et al. | 280/626 |

FOREIGN PATENT DOCUMENTS

| | | |
|---|---|---|
| FR | 2 418 657 | 9/1979 |
| FR | 2 788 443 | 7/2000 |

OTHER PUBLICATIONS

Preliminary Search Report In SN FR 0210484.

* cited by examiner

*Primary Examiner*—J. Allen Shriver
(74) *Attorney, Agent, or Firm*—Bugnion S.A.; John Moetteli

(57) ABSTRACT

The front binding (1) comprises two jaws (5*a*, 5*b*) holding a boot vertically and laterally by means of their actions on the sole of the boot and articulated on a carriage (4) that is movable in translation between two extreme positions in which the action of the carriage (4) on release means gives rise to the release of the boot by rocking of one or other of the jaws (5*a*, 5*b*). The carriage (4) is returned to an intermediate position by an elastic means. The binding is noteworthy in that the rocking pins of the jaws (5*a*, 5*b*) are parallel to the longitudinal axis of the binding. The binding makes it possible to hold a boot having a sole that makes it easier for the user to walk.

12 Claims, 8 Drawing Sheets

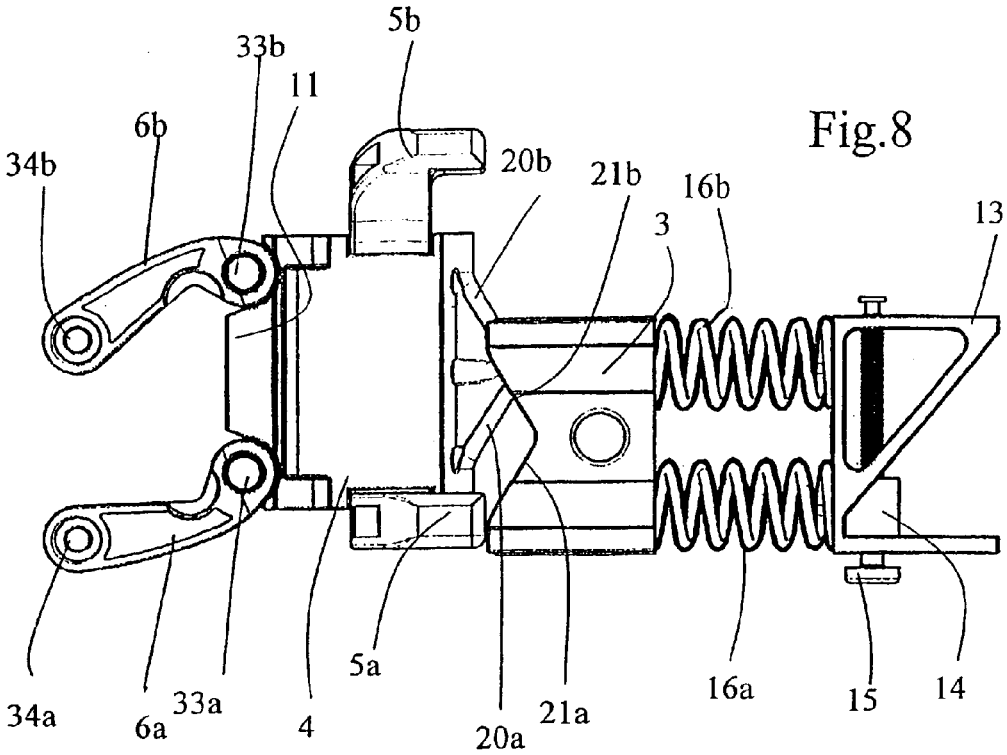
Fig.8
Fig.9
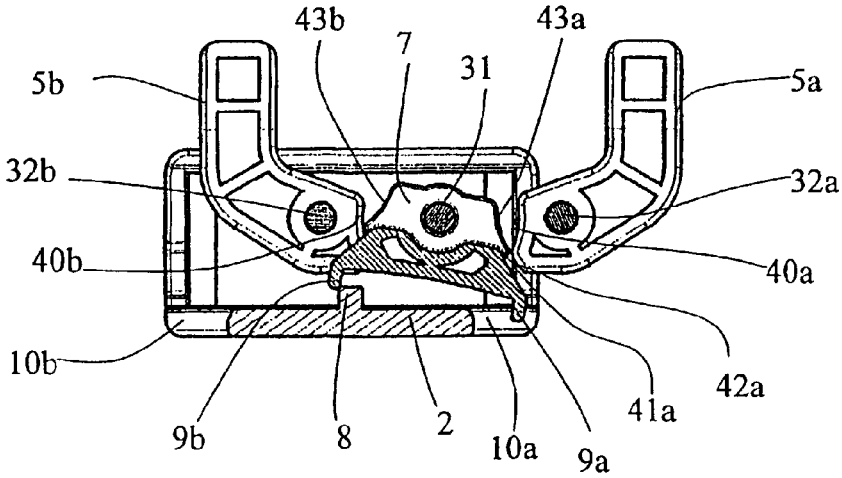

FRONT BINDING FOR GLIDING-SPORTS DEVICE

BACKGROUND OF THE INVENTION

The present invention relates to a front binding of a gliding device defined in the preamble of claim 1.

PRIOR ART

Gliding sports involve contradictory stresses involving the structure of boots. On the one hand, they have to have rigid elements allowing the user to guide the gliding device with precision and to feel the response of the device to the forces he exerts. On the other hand, they have to have flexible elements to guarantee the user's comfort.

For practicing gliding sports, such as snowboarding, in which it is possible to connect the boot to the gliding device by means of straps, it is possible to produce boot soles that are flexible in order to improve the user's walking comfort. Such soles absorb shocks due to the contact of the boot on the ground upon each step. They also facilitate the gripping of the boot on the ground by means of their deformation.

When boots are connected to the gliding-sports devices via the front and the rear of the sole, as is the case with traditional alpine-ski bindings, the sole has to be rigid. In order to improve walking comfort, it is known to attach, to the front and to the rear of the sole, additional elements made from a flexible material. However, the standard defining the characteristics with which the boots have to comply in the case of these conventional bindings requires the presence, at the front and at the rear of these boots, of zones that have to have a high level of hardness and a low friction coefficient relative to the binding in order to make the binding easy to enter and to release the boot properly in the event of a fall.

Patents FR 2 788 443, and FR 2 418 657, disclose a gliding-board binding comprising essentially a chassis integral with the board for gliding, and two jaws for holding the boot that have the form of levers articulated about longitudinal pins and each returned to a position of balance, holding a boot on the board for gliding. These levers penetrate housings made on either side of the sole of the boot. A lever makes it possible to influence die two lateral jaws against the action of a spring in order to allow voluntary release. The holding jaws and the housings made in the sole of the boot have forms allowing release in the event of a forward fall, a rearward fall or a twisting of the foot.

These embodiments reduce the length of the sole of the boot, which no longer needs standard curbs at the rear, and thus facilitate walking. Furthermore, they allow the production of a sole composed principally of flexible materials and having a form that facilitates rolling of the foot during walking.

By virtue of such systems, it is no longer necessary to provide a block, between the upper surface of the board for gliding and the sole of the boot, to enhance skiing with parabolic skis. This is because the springs and other components required for the operation of such bindings are placed under the sole of the boot and substantially raise it relative to the upper surface of the board for gliding.

U.S. Pat. No. 4,930,802, the content of which is incorporated by reference, discloses a front alpine-ski binding having two arms for bearing on the front curb of the sole of a standard ski boot in order to hold it vertically and laterally. The two arms are articulated about vertical pins and pivot, under certain conditions, about said pins in order to allow the boot to be released in the event of a fall. These two arms are connected to a carriage that can be displaced in a circular translational movement between two extreme positions in which the right arm or the left arm is allowed to pivot in order to release the boot. The carriage is returned by an elastic means to an intermediate position between these two extreme positions in which pivoting of the arms is prevented.

Such bindings present drawbacks. The safety release of the first two bindings is achieved by means of the interaction of slopes formed in the sole of the boot and on the binding. The slopes produced in the soles of the boots are exposed to external wear and tear, which risks damaging them or modifying their surface condition and modifying the release stiffnesses.

The latter binding is designed to operate with standard-sole boots. They consequently allow only very little modification of forms and materials to enhance walking comfort.

SUMMARY OF THE INVENTION

The object of the invention is to produce a front binding of a gliding device that improves existing front bindings and attenuates the drawbacks previously cited. In particular, the invention proposes producing a front binding for a gliding device that can hold a boot having a sole that facilitates the user's walking.

The front binding of a gliding device according to the invention is noteworthy in that the rocking pins of the jaws are parallel to the longitudinal axis of the binding.

Indeed, such jaws make it possible to hold the front of the boot on these sides and to produce boot soles with a non-standard front part that, owing to its geometry, facilitates walking.

Dependent claims 2 to 11 define different embodiments of the binding.

BRIEF DESCRIPTION OF THE DRAWINGS

The appended drawing shows, by way of non-limiting example, an embodiment of the front binding according to the invention.

FIG. 8 is a view similar to FIG. 6, the carriage being shown in one of these extreme positions.

FIG. 9 is a view similar to FIG. 7, the carriage being shown in one of its extreme positions.

DESCRIPTION OF THE PREFERRED EMBODIMENTS

Figure 1:
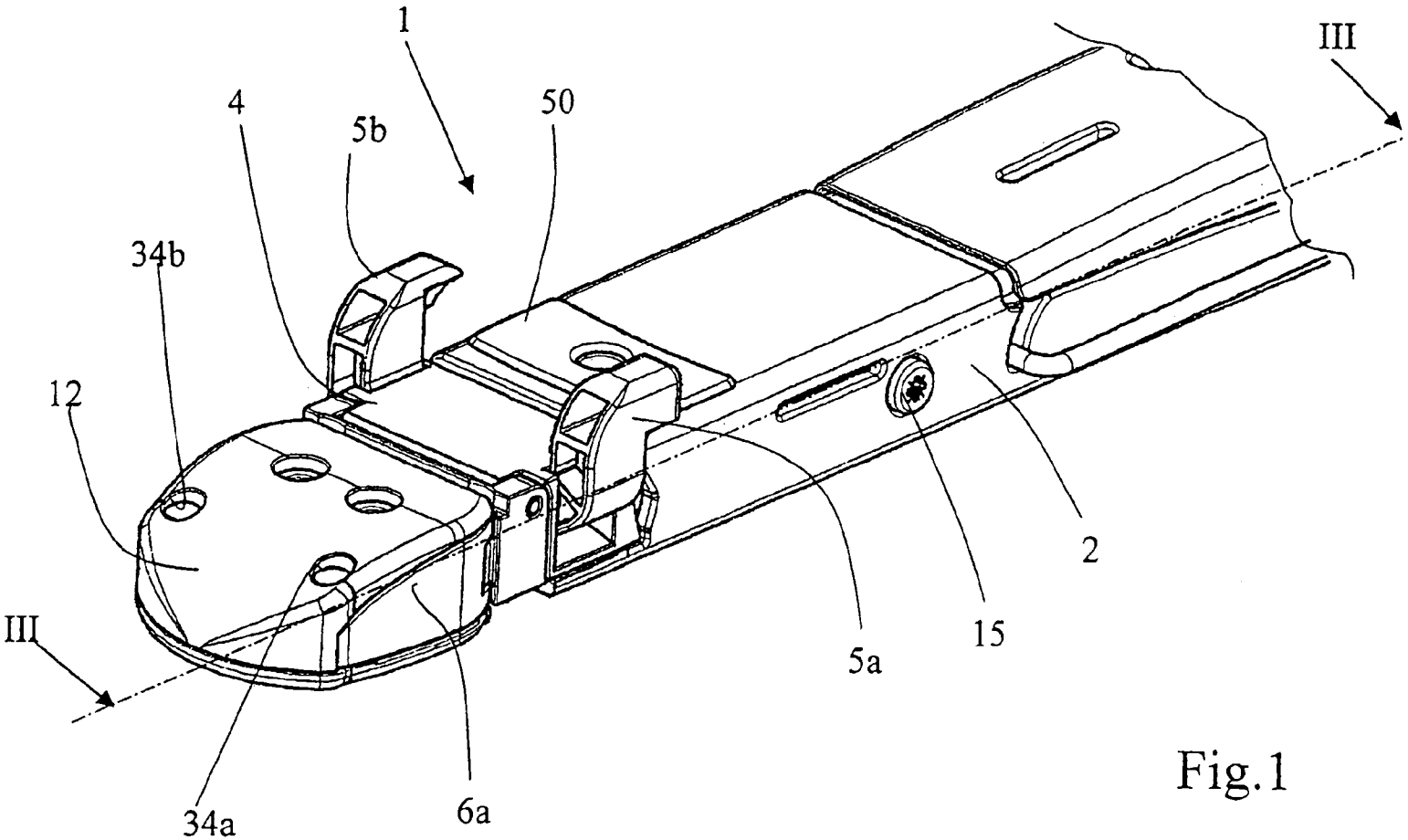
FIG. 1 is a perspective view of the front binding according to the invention.
Figure 2:
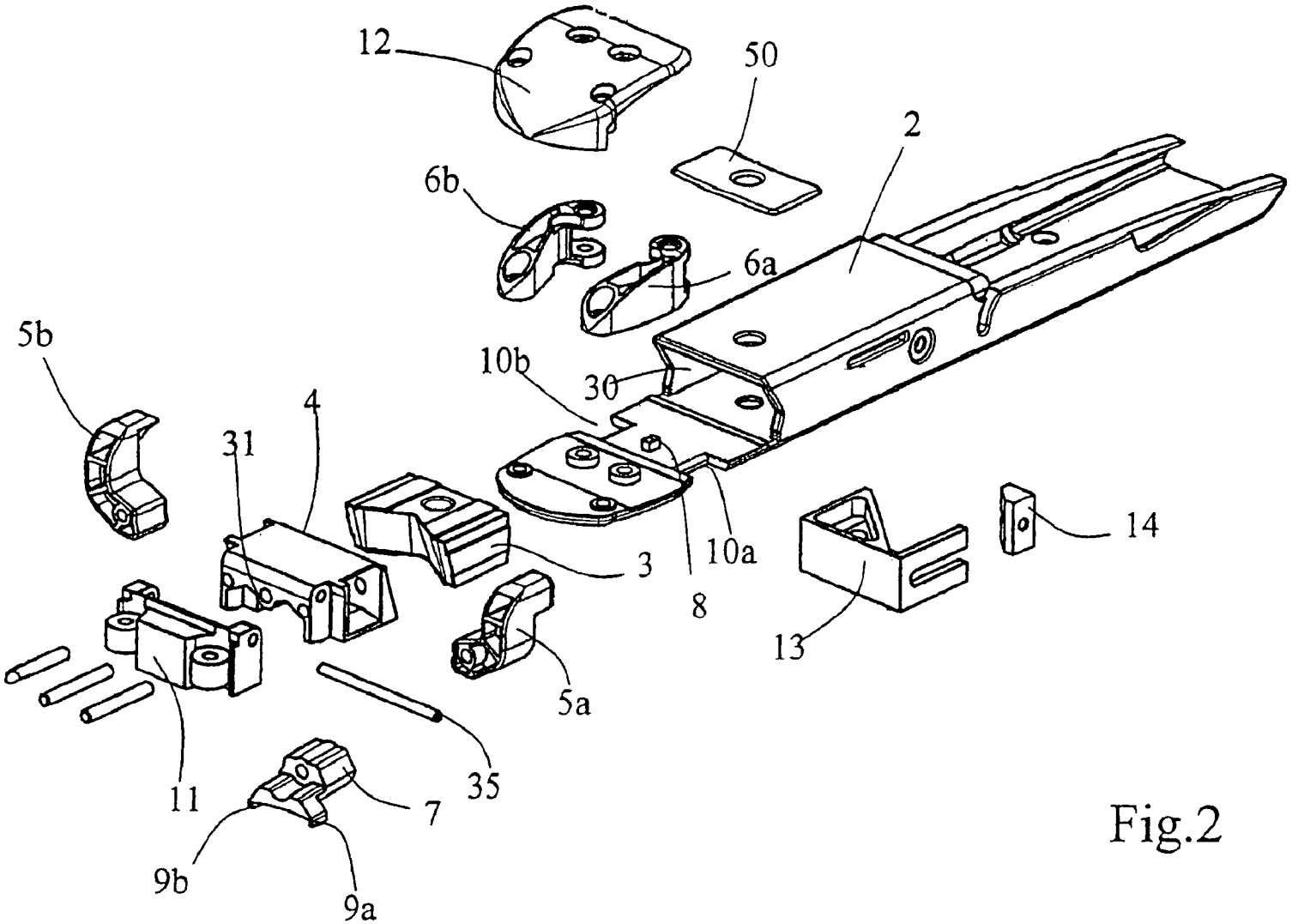
FIG. 2 is an expanded perspective view of the front binding according to the invention.
Figure 3:
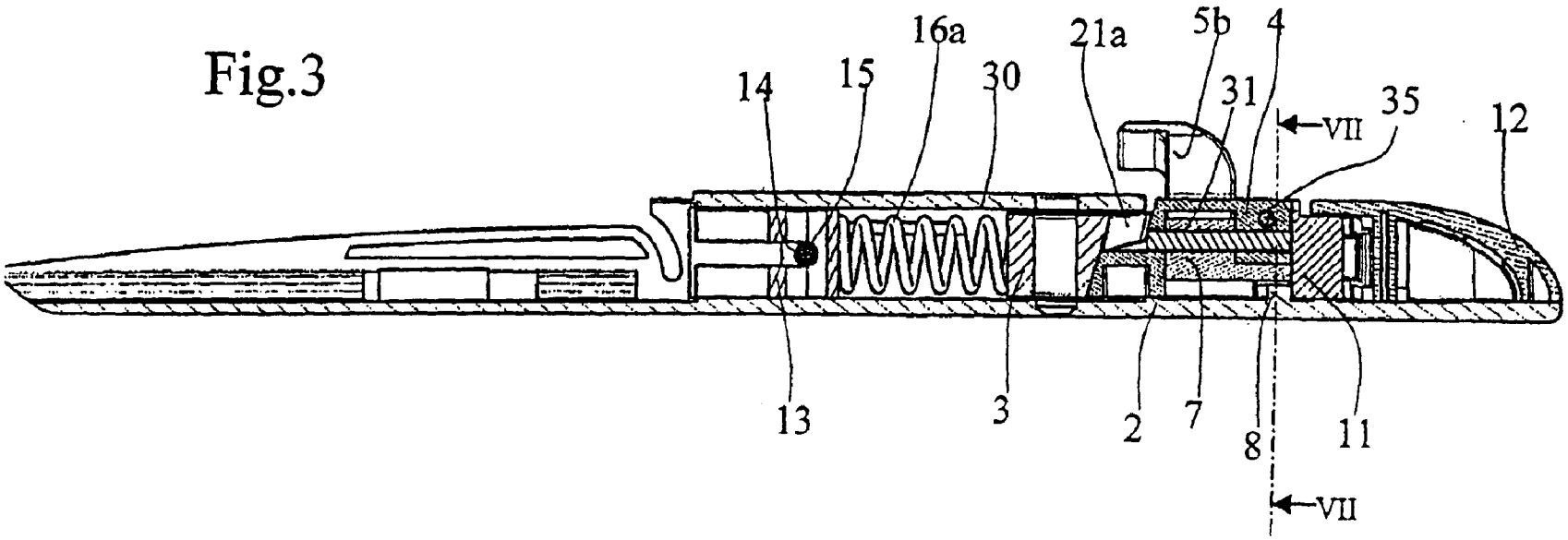
FIG. 3 is a view, in longitudinal section, of the front binding on III—III in FIG. 1.
Figure 4:
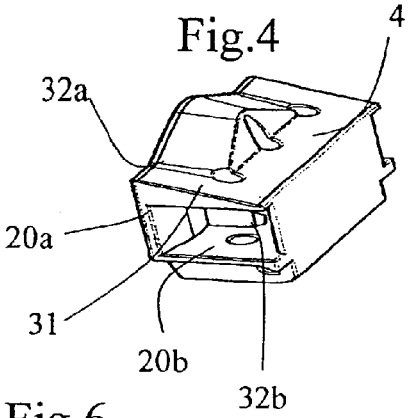
FIG. 4 is a perspective view of the carriage of the binding according to the invention.
Figure 5:
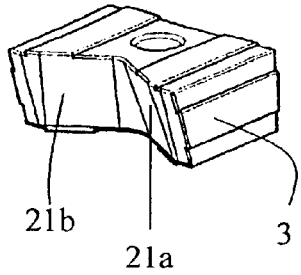
FIG. 5 is a perspective view of the piston of the binding according to the invention.

The front binding 1 of an alpine ski shown in FIGS. 1, 2, and 3 is designed for fixing on a ski (not shown) and for interacting with a rear binding, such as a conventional heelpiece binding, in order to connect it to a boot. Consequently, it has to hold the front of the boot vertically and laterally and form a front stop for the boot.

Figure 10:
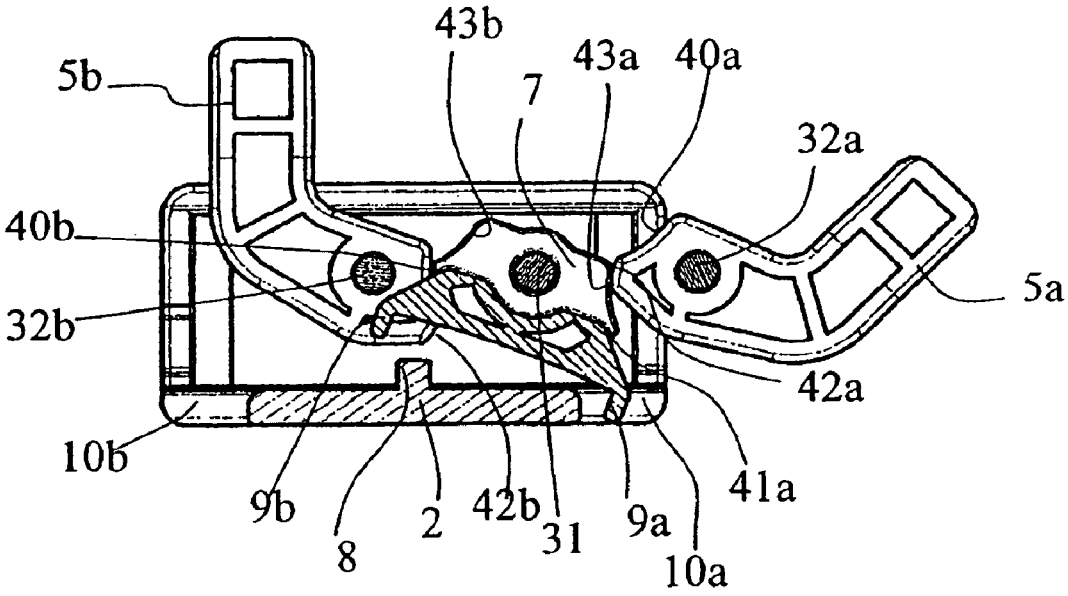
FIG. 10 is a view similar to FIG. 9, one of the jaws being shown after it has rocked.
Figure 11:
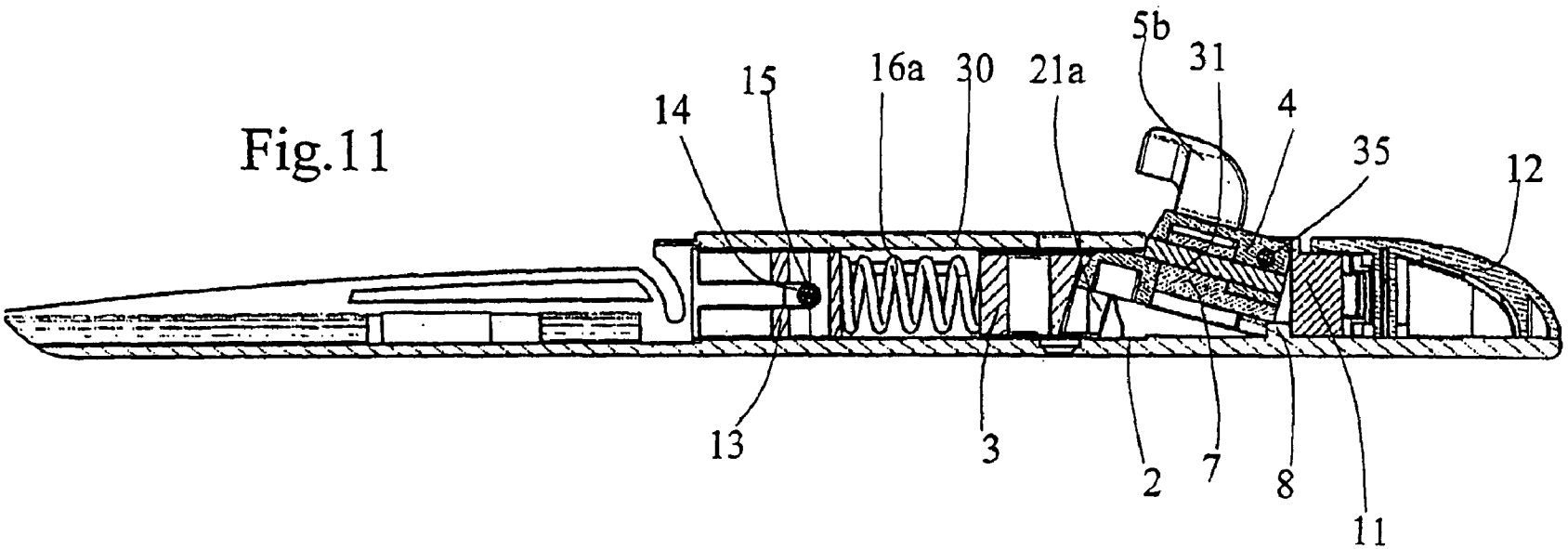
FIG. 11 is a sectional view similar to FIG. 3, the carriage being shown after it has pivoted in the event of a rearward fall.
Figure 12:
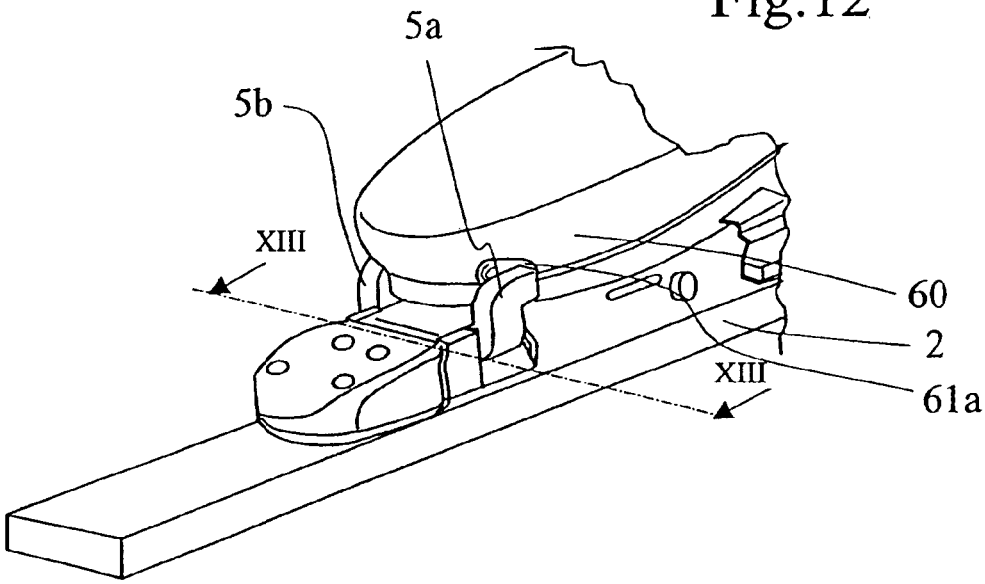
FIG. 12 is a perspective view of the front binding holding a boot.
Figure 13:
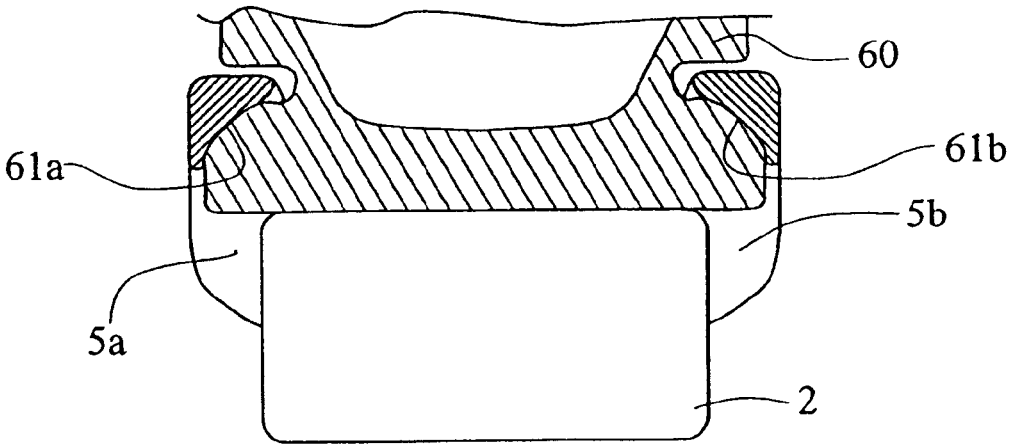
FIG. 13 is a view, in transverse section, of the binding and of the boot on XIII—XIII in FIG. 12.

The front binding 1 comprises principally a chassis 2 in which is mounted, so as to be transversely movable, a carriage 4 carrying jaws 5*a* and 5*b* bearing on forms made in the sole of the boot in order to hold it. As shown in FIG. 10, these jaws are able to rock about horizontal pins 32*a* and 32*b*, respectively, in order to release the boot when the carriage reaches one or the other of its extreme positions. As shown in FIG. 11, the carriage 4 is articulated about a transverse pin 35 in order to release the boot when the front of the latter rises during a rearward fall.

Figure 6:
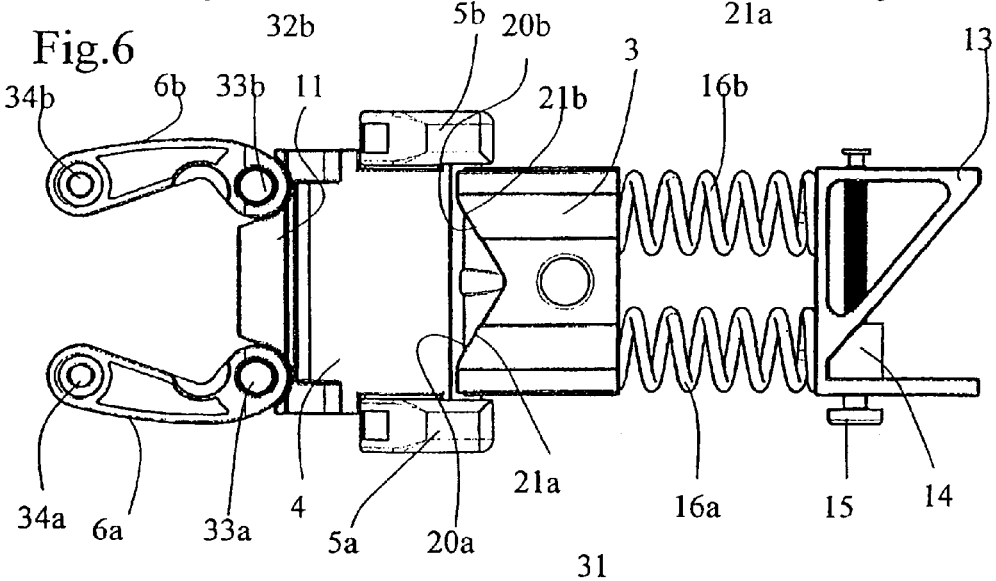
FIG. 6 is a plan view of the binding shown without the chassis.

As shown in FIG. 6, at the front end of the binding 1, two arms 6*a* and 6*b* that are symmetric relative to the longitudinal axis of the ski are articulated on the chassis 2 about two vertical pins 34*a* and 34*b*. These two arms are articulated at their other ends on a support 11 about two pins 33*a* and 33*b* that are vertical and symmetric relative to the axis of the ski. These two arms are streamlined by means of a front cover 12.

The carriage 4 is connected to this support 11 about the transverse pin 35. The assembly formed by the support 11 and the carriage 4 is thus movable relative to the chassis 2 or to the ski in a circular translational movement that will be similar, given the small amplitude of this movement during the operation of release of the binding, to a transverse translational movement.

The arms 5*a* and 5*b* are articulated on the carriage 4 about longitudinal pins 32*a* and 32*b* such that when they rock in order to release the boot they can withdraw completely, i.e. they can be located entirely below the upper surface of the chassis 2.

Figure 7:
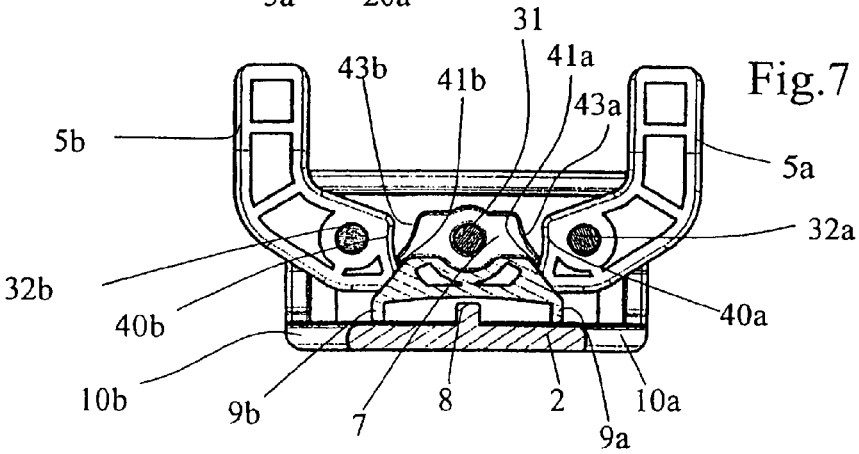
FIG. 7 is a view, in transverse section, of the binding on VII—VII in FIG. 3, the carriage being in its intermediate position.

A rocker 7 is articulated on the carriage 4 about pin 31 between the articulation pins of the jaws. The rocker has convex stops 41*a* and 41*b* having the form of cylindrical surfaces of pin 31 interacting with the ends 40*a* and 40*b* of the jaws having concave complementary surfaces in order to prevent their rocking and to allow the rocking of the rocker when the carriage 4 is in its intermediate position shown in FIG. 7.

The jaws 5*a* and 5*b* have, respectively, convex cylindrical surfaces 42*a* and 42*b* of pin 32*a* and 32*b* interacting with concave complementary surfaces 43*a* and 43*b* made on the rocker 7 in order to allow the rocking of the jaws 5*a* and 5*b* when the rocker is rocked.

The rocker also has two lower tabs 9*a* and 9*b* interacting with a stop 8 integral with the chassis 2.

In its rear part, the carriage 4 has a male V made by two slopes 20*a* and 20*b* interacting with a female V made by two slopes 21*a* and 21*b* formed on the front part of a piston 3 that can move in translation in a guide 30 made in the chassis 2. These two Vs have, respectively, in the direction of their axis, a complementary taper and counter-taper. The piston 3 has a substantially rectangular section enabling it to be translated in the guide 30, which has a complementary cross section. The piston is subject to the action of two compression springs 16*a* and 16*b*, acts against the carriage 4, and therefore allows, by means of the contact forces from the piston 3 on the carriage 4, the carriage to return to its intermediate position shown in FIG. 1.

As shown in FIG. 6, the two springs 16*a* and 16*b* bear on a stop 13, the axial position of which may be adjusted by the transverse positioning of a wedge 14 that can be displaced by a screw 15 in pivoting connection with the chassis 2 and screwed into the wedge 14. The various positions that this stop 13 may occupy make it possible to adjust the binding's safety release stiffness.

A small plate 50 with a low friction coefficient relative to the sole of the boot is fixed on the upper face of the chassis of the binding. This makes it possible to guarantee quality entering into and withdrawing from the binding.

In the event of the safety release of the binding owing to the foot being twisted relative to the ski about the axis of the leg, the front end of the boot 60 is displaced laterally by sliding over the small plate 50. As shown in FIG. 8, this displacement gives rise to the displacement of the support 11, carriage 4, and jaws 5*a* and 5*b* assembly through the action of the boot 60 on the jaws 5*a* and 5*b*. This displacement takes place against the action of the piston 3 on the carriage 4, which, subject to the forces of the springs 16*a* and 16*b*, exerts an action of contact of its face 21*b* on the face 20*b* of the carriage, tending to bring the carriage into its intermediate position shown in FIGS. 1 and 6. The transverse displacement of the carriage 4 relative to the chassis 2 gives rise to that of the rocker 7 relative to the chassis 2.

Taking the example of twisting that tends to apply the front of the boot against the jaw 5*a*, slightly before the arrival of the carriage 4 in an extreme position, the lower tab 9*b* of the rocker 7 comes into contact with the stop 8 of the chassis 2 and the other tab 9*a* of the rocker 7 comes opposite a notch 10*a* formed in the lower wall of the chassis 2, which results in the rocking of the rocker about its pin 31.

The convex stop 41*a* of the rocker slides against the complementary concave surface 40*a* of the jaw 5*a* until they are no longer in contact and allow the rotation of the jaw 5*a*. At this point, through the action of the boot 60, the jaw 5*a* rocks about its pin 32*a*, as shown in FIG. 10. This jaw will completely withdraw, i.e. pass below the upper surface of the chassis 2 in order to release the boot.

Once the boot has been released, the jaw 5*a*is returned, either by an adapted form of the surface 43*a* or by a spring (not shown), to its boot-holding position. The carriage 4 is entrained toward its intermediate position through the action of the piston 3, and the tab 9*a*, abutting against the end of the notch 10*a*, brings the rocker 7 into its original position, shown in FIG. 7. The binding is then once again ready to receive a boot.

In the event of the safety release of the binding in a rearward fall, the front of the boot 60 rises. This rotational movement takes place against the action of the piston 3 on the carriage 4, which, subject to the forces of the springs 16*a* and 16*b*, exerts an action of contact of its faces 21*a* and 21*b* on the faces 20*a* and 20*b* of the carriage, which tends to bring the carriage into its stable position shown in FIGS. 1 and 3.

As soon as the carriage has pivoted by a certain angle about its pin 35, the jaws emerge from their complementary forms 61*a* and 61*b* made on either side of the boot, in the sole.

As soon as the boot has been released, the carriage 4 is returned to its stable position through the action of the piston 3 on the carriage, and the binding is then once again ready to receive a boot.

In a variant of the embodiment previously described, the support 11 is slidably connected to the chassis 2. This slide-type connection may be achieved by two complementary dovetail forms with an axis transverse to the binding.

It is also possible to envisage connecting the carriage and a blade by means of a pivoting connection of transverse axis, the blade being itself in pivoting connection with the chassis 2 about a vertical axis sufficiently far from the jaws for the movement of the carriage between its two extreme positions to be able to be similar to a translational movement or to the movement undergone by the front of the boot relative to the ski during release on account of twisting.

Slopes 20*a* and 20*b* on the carriage 4 and complementary slopes 21*a* and 21*b* on the piston 3 may be produced that are not symmetric, so as to obtain binding release stiffnesses that are different depending on whether twisting takes place toward the inside or toward the outside of the foot.

As instances of release of the front binding in the event of twisting or rearward fall take place against the action of the same elastic means, it is necessary to choose the value of the slopes and of the tapers of the piston and of the carriage so as to obtain a satisfactory release stiffness relationship.

Release of the boot from the ski during a forward fall takes place by means of the safety release of the rear binding, which may consist of a conventional heelpiece.

What is claimed:

1. A front binding (1) of a gliding device, comprising two jaws (5*a*, 5*b*) holding a boot (60) vertically and laterally by means of their actions on the sole of the boot and articulated on a carriage (4) that is movable in translation between two extreme positions in which the action of the carriage (4) on release means (7, 8) gives rise to the release of the boot by rocking of one or other of the jaws (5*a*, 5*b*), the carriage (4) being returned to an intermediate position by an elastic means (16*a*, 16*b*), wherein rocking pins (32*a*, 32*b*) of the jaws (5*a*, 5*b*) are substantially continuously parallel to the longitudinal axis of the binding.

2. The front binding (1) of a gliding device as claimed in claim 1, which has two arms (6*a*, 6*b*) each articulated at one of its ends to a chassis (2), and each articulated at the other of its ends to a support (11) to which the carriage (4) is connected, the four articulations at the ends of the arms (6*a*, 6*b*) forming a parallelogram.

3. The front binding (1) of a gliding device as claimed in claim 1, wherein the carriage is connected to a blade that is itself articulated on the chassis about a vertical axis located to the rear of the binding.

4. The front binding (1) of a gliding device as claimed in claim 1, wherein the carriage and the chassis are connected by a slide-type connection with an axis transverse to the binding.

5. The front binding (1) of a gliding device as claimed in claim 1, wherein the release means comprise a rocker (7) connected pivotably to the carriage (4) and having one angular position that prevents the rocking of the two jaws (5*a*, 5*b*), one angular position allowing the rocking of the right jaw (5*b*) on its own and one angular position allowing the rocking of the left jaw (5*a*) on its own.

6. The front binding (1) of a gliding device as claimed in claim 1, wherein the carriage (4) has slopes (20*a*, 20*b*) interacting with slopes (21*a*, 21*b*) of a piston (3) subject to the action of the elastic means (16*a*, 16*b*) in order to return the carriage (4) to its intermediate position.

7. The front binding (1) of a gliding device as claimed in claim 6, wherein the slopes (20*a*, 20*b*) of the carnage (4) and the complementary slopes (21*a*, 21*b*) of the piston (3) are not symmetric.

8. The front binding (1) of a gliding device as claimed in claim 1, wherein the carriage (4) pivots against the action of the elastic means (16*a*, 16*b*) about a pin (35), transverse to the binding, located in front of the jaws (5*a*, 5*b*) in order to allow the boot (60) to be released from the jaws (5*a*, 5*b*) when the front of the boot (60) rises.

9. The front binding (1) of a gliding device as claimed in claim 8, wherein the carriage (4) has slopes (20*a*, 20*b*) interacting with slopes (21*a*, 21*b*) of a piston (3) subject to the action of an elastic means (16*a*, 16*b*) in order to return the carriage (4) to its intermediate position.

10. The front binding (1) of a gliding device as claimed in claim 9, wherein the slopes (20*a*, 20*b*) of the carriage (4) and the complementary slopes (21*a*, 21*b*) of the piston (3) are not symmetric.

11. The front binding (1) of a gliding device as claimed in claim 9, wherein the piston (3) and the carriage (4) have complementary tapers so that the action of the elastic means (16*a*, 16*b*) on the piston (3) makes it possible to return the carriage (4) about the transverse pin (35) to a position in which the boot (60) is held.

12. The front binding of a gliding device as (1) claimed in claim 10, wherein the piston (3) and the carriage (4) have complementary tapers so that the action of the elastic means (16*a*, 16*b*) on the piston (3) makes it possible to return the carriage (4) about the transverse pin (35) to a position in which the boot (60) is held.

* * * * *